US005501324A

United States Patent [19]

Franklin et al.

[11] Patent Number: 5,501,324

[45] Date of Patent: Mar. 26, 1996

[54] SOFT-SIDED LUGGAGE CASE WITH INTERFITTING AND FOLDABLY SEPARATE PACKING COMPARTMENTS

[75] Inventors: Dana Franklin; Bonnie M. Earl, both of Denver, Colo.

[73] Assignee: Samsonite Corporation, Denver, Colo.

[21] Appl. No.: 182,408

[22] Filed: Jan. 18, 1994

[51] Int. Cl.[6] ..... B65D 85/18

[52] U.S. Cl. ..... 206/279; 190/109; 206/280

[58] Field of Search ..... 190/109, 111, 190/127, 18 A; 206/279, 278, 280, 287.1

[56] References Cited

U.S. PATENT DOCUMENTS

| | | | |
|---|---|---|---|
| D. 277,431 | 2/1985 | Bomes et al. . | |
| 2,181,587 | 11/1939 | Plotkin | 190/109 |
| 2,609,073 | 9/1952 | McLaughlin | 190/109 X |
| 2,839,167 | 6/1958 | Smith . | |
| 3,944,032 | 3/1976 | Samhammer et al. | 206/287.1 X |
| 4,693,368 | 9/1987 | King et al. | 206/287.1 |
| 4,759,431 | 7/1988 | King et al. . | |
| 4,854,431 | 8/1989 | Pulichino, Jr. et al. | 206/280 X |
| 4,925,021 | 5/1990 | Pulichino, Jr. | 206/279 |
| 4,995,487 | 2/1991 | Plath . | |
| 5,054,589 | 10/1991 | Bomes et al. | 191/110 X |
| 5,060,795 | 10/1991 | Bomes et al. | 206/287.1 X |
| 5,108,119 | 4/1992 | Huang . | |
| 5,117,974 | 6/1992 | Bieber | 206/278 |
| 5,253,739 | 10/1993 | King . | |

OTHER PUBLICATIONS

Orvis Clothing and Gifts, Spring 1994, vol. II, No. 2, p. 15CC, Item J.

*Primary Examiner*—Allan N. Shoap
*Assistant Examiner*—Christopher J. McDonald
*Attorney, Agent, or Firm*—John R. Ley; John B. Phillips

[57] ABSTRACT

An openable and closeable soft-sided luggage case having an external flexible panel, an internal frame structure surrounding an internal cavity, and a carrying handle or a carrying strap connected to the frame structure, includes a first packing compartment which is connected to the external panel. The first packing compartment extends into the interior cavity and consumes a portion of the interior cavity when the case is closed. The remaining portion of the interior cavity forms a second packing compartment. The first packing compartment includes a cover member which is selectively closeable for separating the first and second packing compartments when the case is closed and which is selectively openable for allowing access to the first packing compartment when the case is opened. The first and second packing compartments are equally accessible and available for packing. The first packing compartment may function as a garment bag. A packing and unpacking method is also used for the case.

45 Claims, 5 Drawing Sheets

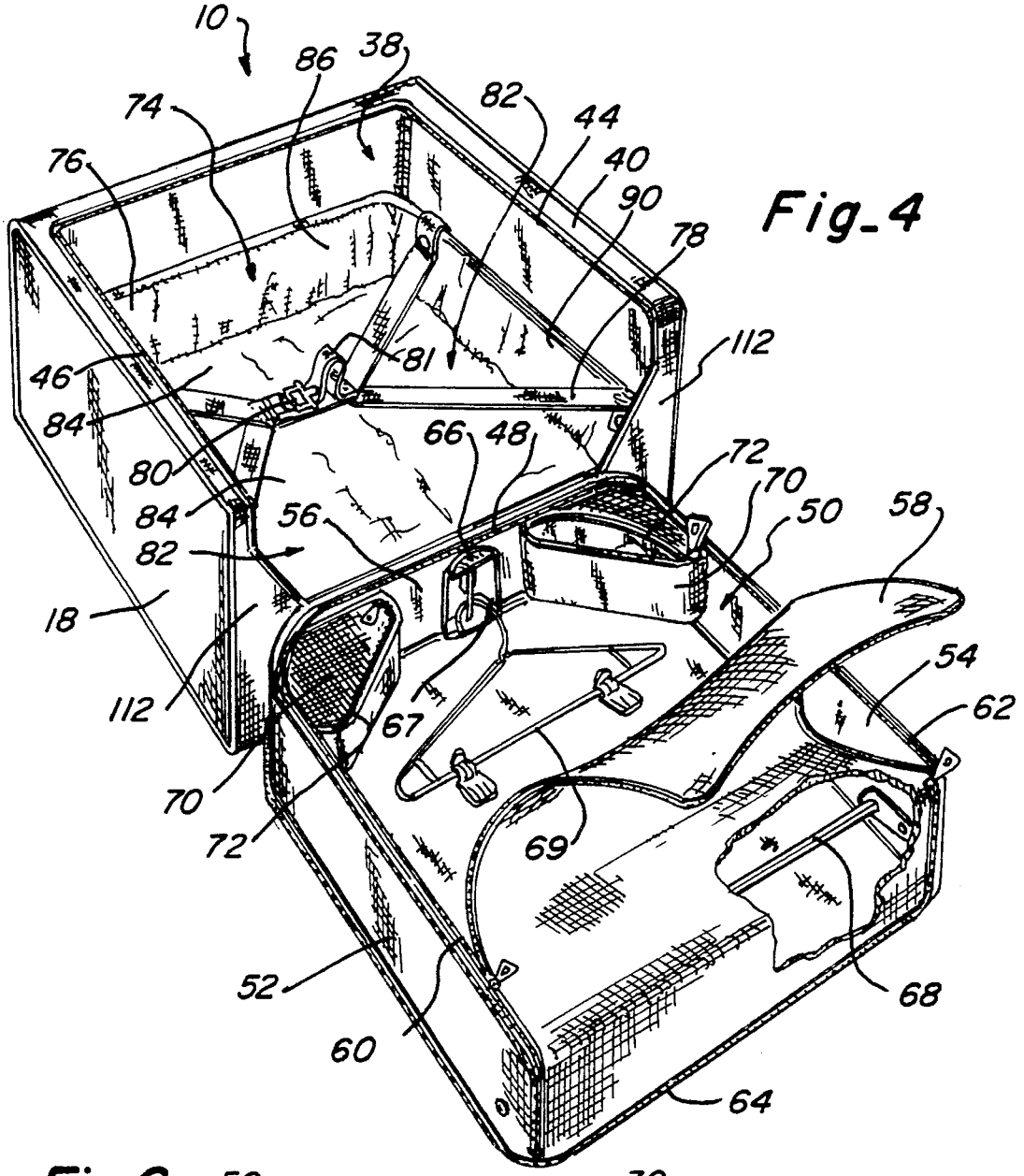
Fig_4
Fig_6
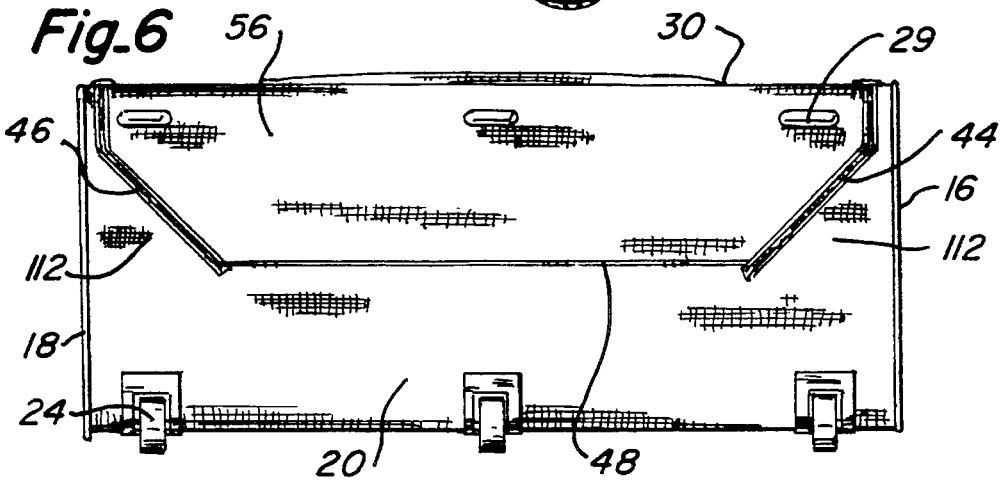

SOFT-SIDED LUGGAGE CASE WITH INTERFITTING AND FOLDABLY SEPARATE PACKING COMPARTMENTS

This invention relates to soft-sided luggage cases, and more particularly to a new and improved soft-sided luggage case having two interfitting packing compartments, which, when unfolded, provide equal access to each compartment for the convenience of packing and unpacking the luggage case.

BACKGROUND OF THE INVENTION

Soft-sided luggage cases have gained considerable popularity with travelers as an alternative to using the more traditional hard-sided luggage cases to pack and transport their clothing and personal care items while traveling. Many travelers prefer the style and convenience of use which is attained by sewing the relatively flexible cloth or material-like panels together to create soft-sided luggage. From a stylistic standpoint, the appeal of soft-sided luggage results from the distinctive appearance created by the sewing, by the beads where panels join together, by zippers for connecting components together and by the distinctive colors and patterns which may be created from the flexible panels of material. From a utilitarian standpoint, soft-sided luggage provides more convenient access to pockets and the interior of the case, and is generally lighter in weight. These functional features, when combined with some amount of flexibility, result in a luggage case that is convenient to use and more easily handled than hard-sided luggage.

Examples of soft-sided luggage include garment bags, duffle bags, roll bags, small flight cases, carpet bags and large rectangularly shaped suitcase or Pullman cases. Some soft-sided luggage such as duffle bags and roll bags are formed entirely by sewing or connecting the flexible panels together. However, most of the larger sized soft-sided luggage cases, such as garment bags and rectangular suitcase-like cases, require some type of internal structural to give shape to the case and to allow the case to obtain its intended functionality. The internal structural typically involves the use plastic stiffeners, wires and semi-rigid members which are sewn, attached or otherwise assembled with the panels when the case or bag is manufactured.

One of the important functions of the stiffeners and internal structural elements in some of the larger soft-sided luggage cases, such as the rectangularly shaped suitcases and garment bags, is to provide an ability for the case itself to retain a relatively large amount of weight without deforming unacceptably. The internal structural elements are frequently required to support the weight of the items within the case and to allow the case and its weight to be carried by a carrying handle or the shoulder strap. In addition, recent trends in soft-sided luggage have included using roller wheels and maneuvering handles to allow the larger cases to be transported more easily. In order for the wheels and the maneuvering handles to achieve adequate functionality, more rigid internal elements must be incorporated within the soft-sided cases.

Because of the requirements that the case be carried by the carrying handle or by the shoulder strap located along the top panel, and the requirement that some soft-sided cases incorporate wheels and a maneuvering handle, it is typical that the soft-sided cases are built with a drum construction. The drum construction generally provides a relatively stiff and weight-supporting peripheral frame structure which extends around the top, bottom and end panels of the case, thereby providing a vertically oriented, rectangularly shaped, closed frame structure when viewed from the perspective of the case being carried by the carrying handle or by a shoulder strap on the top panel. Large flexible panels of material extend across the opening of the internal rectangular frame structure somewhat as a drum membrane extends across the opening defined by the periphery of a drum. The internal rectangular frame structure allows the carrying handle or the shoulder strap attachment points to be adequately connected to the case so it can be carried with substantially deforming, and provides a structure capable of supporting the weight of the internal contents of the case. Furthermore, the rectangular peripheral structure provides attachment points for the wheels at the bottom panel, and allows the maneuvering handle to attach to the peripheral frame structure to assure adequate control over the luggage case.

Access to the interior of the case is typically provided by a zippered flap in one of the external face panels. Opening the zipper allows the flap to fold back and provide access for packing and unpacking the interior cavity of the case. Generally, packing is accomplished by placing the case on its bottom exterior face panel while the zippered flap in the upper exterior face panel is folded back.

One of the inconveniences associated with the drum-type soft-sided luggage construction is that the entire internal cavity of the case must be packed and unpacked from the single access flap opening in the upper exterior face panel. Every piece of clothing or personal item packed into the internal cavity rests on the clothing or personal items below it. Packing must be done in a sequential order, and the placement of items within the interior must be thought out carefully to avoid excessive wrinkling of clothing items and to provide adequate access to all of the items within the internal cavity. If the traveler elects not to unpack the luggage case at the traveler's destination, it can be difficult to search through the entire contents of the case to locate a desired clothing or personal item.

The traditional hard-sided suitcase, which is formed by two concave rigid shells which are hinged together, is more convenient for packing and unpacking than a soft-sided case using the drum construction. The hard-sided suitcase provides essentially two separate packing compartments formed by the concave interior of each shell. Because of the hinged construction, each shell is fully exposed when the suitcase is unfolded in a horizontal position. Thus, packing, searching and unpacking clothing from the hard-sided suitcase is more convenient because the two packing compartments are essentially separate and access to each is totally independent of the other.

The advantages of independent access and equal division of the entire packing capacity of a hard-sided suitcase have not been available in soft-sided luggage cases because of the inherent requirements for the internal peripheral frame in drum constructed soft-sided luggage. Further, the strength of drum type construction is necessary to carry the case by the carrying handle or shoulder strap, and also possibly to maneuver the case on its wheels. It is impractical or impossible to split the frame structure into two separable portions and have them pivot with respect to one another because of the additional need for maximum strength available from relatively flexible and less rigid structural materials.

Thus, the packing, unpacking and other disadvantages associated with a single access flap into the complete internal cavity within a drum constructed soft-sided luggage case have been accepted by travelers.

It is with respect to these background considerations associated with soft-sided luggage that the present invention has evolved.

SUMMARY OF THE INVENTION

A significant aspect of the present invention is to obtain the convenience in a soft-sided, drum-constructed luggage case of independent equal access to two substantially sized packing compartments normally found only in conventional hard-sided suitcases. The convenience of equal access to two packing compartments in a soft-sided case achieves comparable convenience for packing and unpacking in a soft-sided case as a hard-sided suitcase without sacrificing the style, the convenience and utilitarian features of a soft-sided luggage case. Another aspect of the present invention is to create a soft-sided luggage case which will open for packing and unpacking to provide access to two separate packing areas rather than a single cavity, but which is constructed with the style and in the manner typical of soft-sided luggage without using additional hardware or mechanical devices to achieve this functionality. A further aspect of the present invention is to obtain a soft-sided luggage case in which two packing compartments within the case are made available for equal access in packing and unpacking, but in which the maximum amount of clothing and personal care items which can be packed into each compartment is easily determined to avoid overpacking the case. A further aspect of the present invention is to provide a soft-sided luggage construction in which two packing compartments are provided, equal access is provided to each compartment, the two packing compartments interfit within the interior of the luggage case, and the two packing compartments fold away from each other to provide equal access for packing and unpacking.

In accordance with these and other aspects, an openable and closeable soft-sided luggage case of the present invention has at least one external flexible panel, an internal peripheral frame structure surrounding an internal cavity, and a carrying handle or a carrying strap connected to the frame structure for carrying the case. The case includes a first packing compartment which is connected to the external panel, which extends into the interior cavity and which consumes a portion of the interior cavity when the case is closed. The remaining portion of the interior cavity forms a second packing compartment. The first packing compartment includes a cover member which is selectively closeable for separating the first and second packing compartments when the case is closed and which is selectively openable for allowing access to the first packing compartment when the case is opened with the first packing compartment moved out of the internal cavity of the case. The panel and first packing compartment preferably fold back and away from the interior cavity. Arranged in this manner, the first and second packing compartments are equally accessible and available for packing when the first packing compartment is folded back and away from the interior cavity. The first and second packing compartments may be substantially comparable in size. The internal structure may include a pan-like member having a bottom portion which extends along an exterior face panel and lip portions which extend adjacent to end panels of the case. Wheels for rolling the case and a maneuvering handle by which to maneuver the case on the wheels may be connected to the pan-like member. The first packing compartment obtain a garment bag packing capability.

In accordance with other aspects, the present invention also includes a method of packing and unpacking an openable and closeable soft-sided luggage case of the suitcase type having at least one external flexible panel, an internal peripheral frame structure surrounding an internal cavity, and a carrying handle or a carrying strap connected to the frame structure for carrying the case. The method includes the steps of forming a first packing compartment on the external panel, including an openable and closeable cover member as a part of the first packing compartment, extending the first packing compartment into the interior cavity when the case is closed, consuming a portion of the interior cavity with the first packing compartment when the case is closed, defining a second packing compartment within the case by essentially the remaining portion of the interior cavity not consumed by the first packing compartment when the case is closed, separating the first and second packing compartments when the case is closed by closing the cover member, opening the case by moving the first packing compartment out of the internal cavity, accessing the second packing compartment while packing and unpacking through a space in the case occupied by the external panel when the first packing compartment is moved out of the internal cavity, and accessing the first packing compartment while packing and unpacking by opening the cover member when the first packing compartment is moved out of the internal cavity.

A more complete appreciation for the various new and improved aspects of the present invention, the nature of the present invention itself, and the scope of the present invention can be obtained from the accompanying drawings, which are briefly summarized below, from the following detailed description of a presently preferred embodiment of the invention, and from the appended claims.

DESCRIPTION OF THE DRAWINGS

FIG. 4 is a perspective view of the case shown in FIG. 3, unfolded from the configuration illustrated in FIG. 3, in which two separately accessible and independent packing compartments are illustrated.

FIG. 6 is an end elevational view of a bottom end panel of the case shown in FIG. 3.

DETAILED DESCRIPTION

Figure 1:
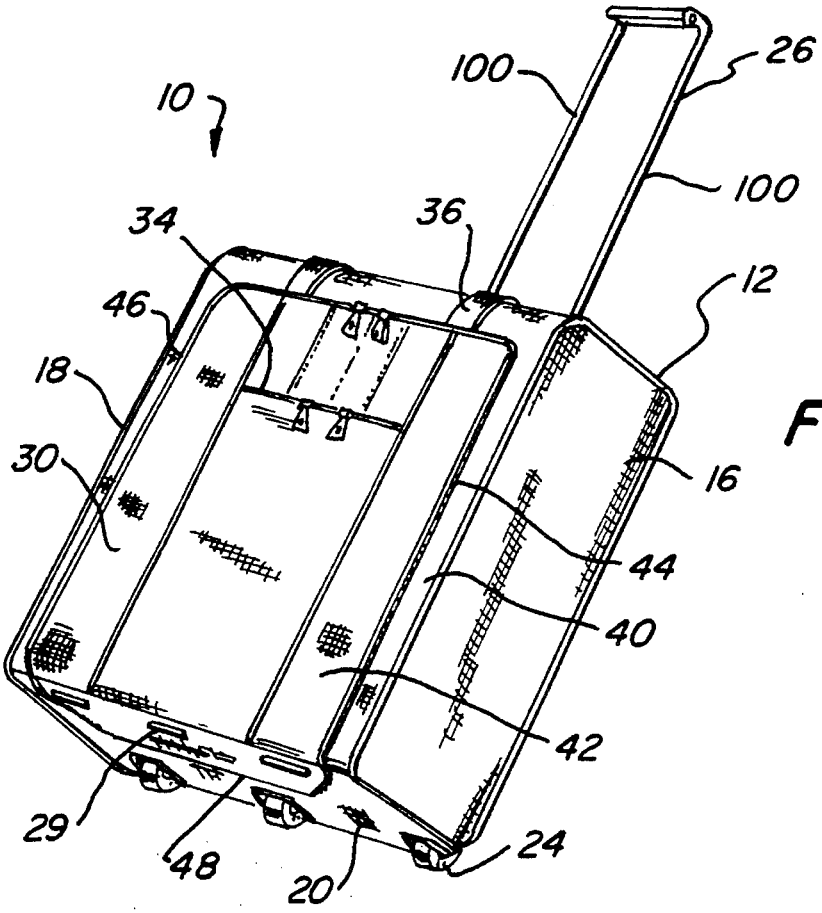
FIG. 1 is a perspective view of a rectangularly shaped, suitcase like, soft-sided luggage case having roller wheels and a maneuvering handle shown in an extended position, in which the present invention is embodied.
Figure 2:
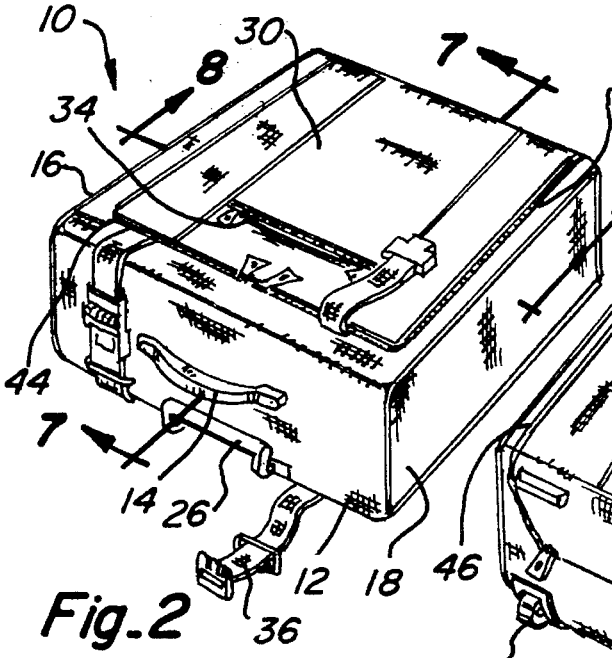
FIG. 2 is a perspective view of the luggage case shown in FIG. 1 with the maneuvering handle in a retracted position, with the case shown in a horizontal position and viewed from an upper top perspective.
Figure 3:
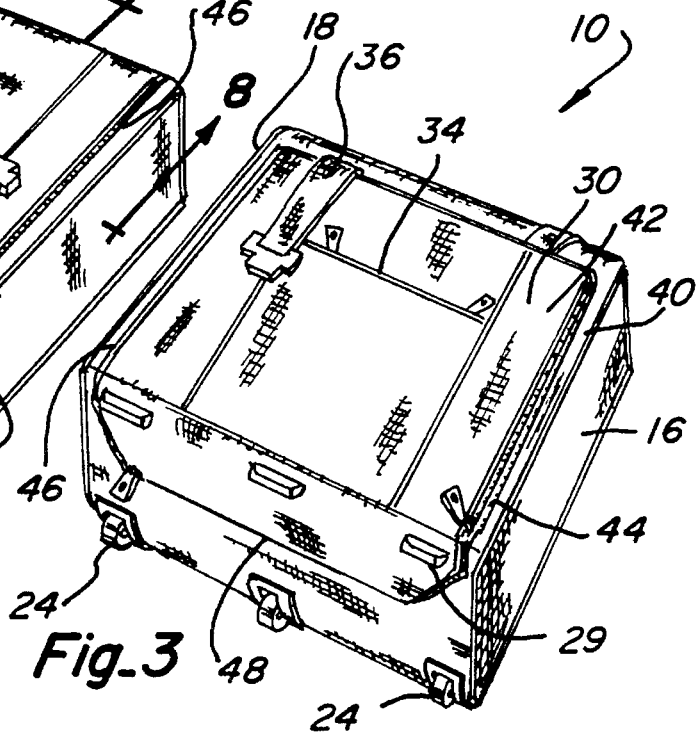
FIG. 3 is a perspective view of the case shown in FIG. 2 viewed from an upper bottom perspective.

The present invention is principally embodied in a soft-sided luggage case 10, as is illustrated in FIGS. 1–3. The case 10 is formed by a top panel 12 to which a carrying handle 14 or a shoulder strap (not shown) is attached. The carrying handle 14 or the shoulder strap allows the case 10 to be carried by the user in a conventional manner. Two end panels 16 and 18 extend downward from the top panel 12 and join to a bottom panel 20. When the case 10 is carried by the carrying handle 14, it will normally be rested with the bottom panel 20 adjacent to a support surface (not shown).

Figure 7:
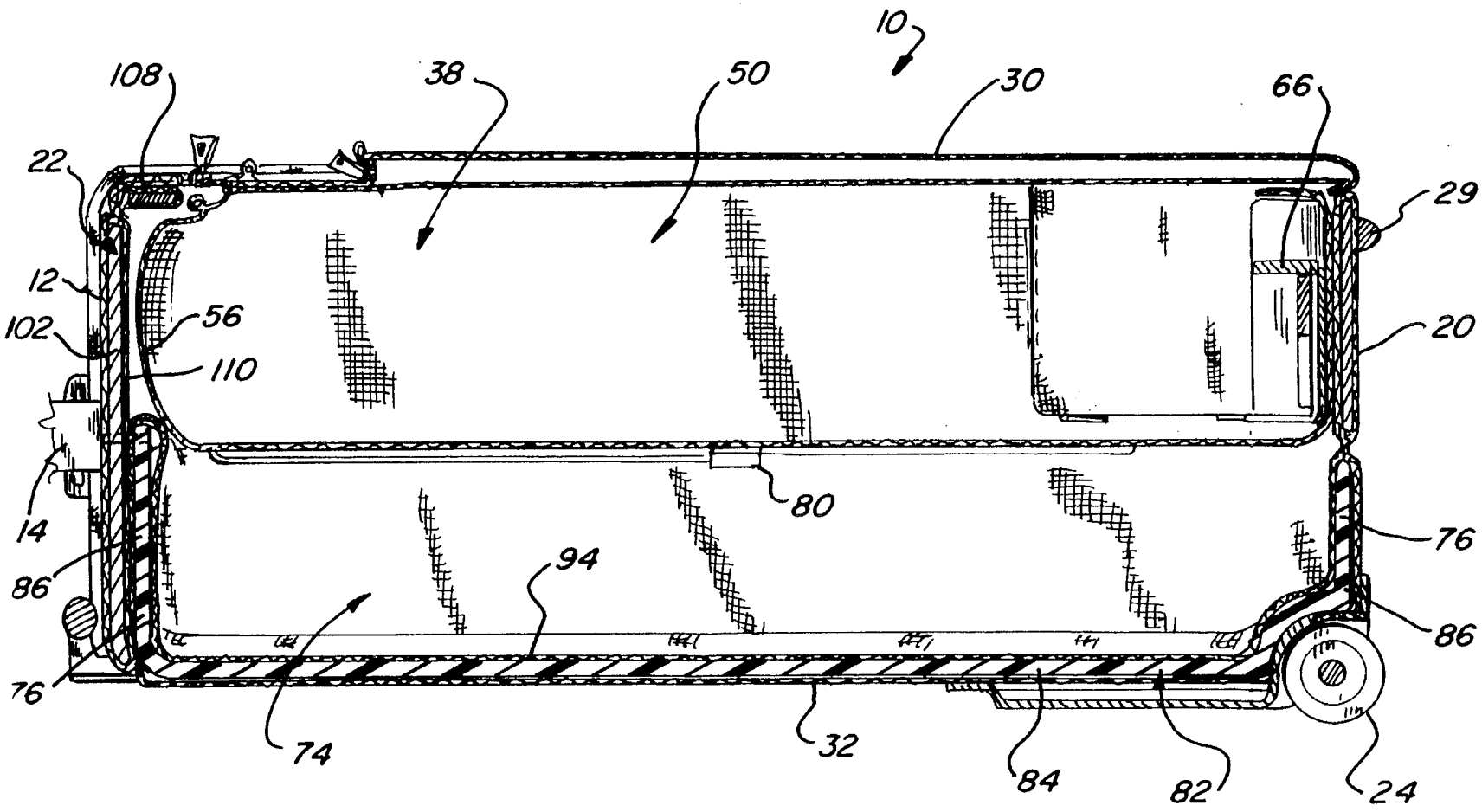
FIG. 7 is a sectional view of the case taken substantially in the plane of line 7—7 in FIG. 2.
Figure 8:
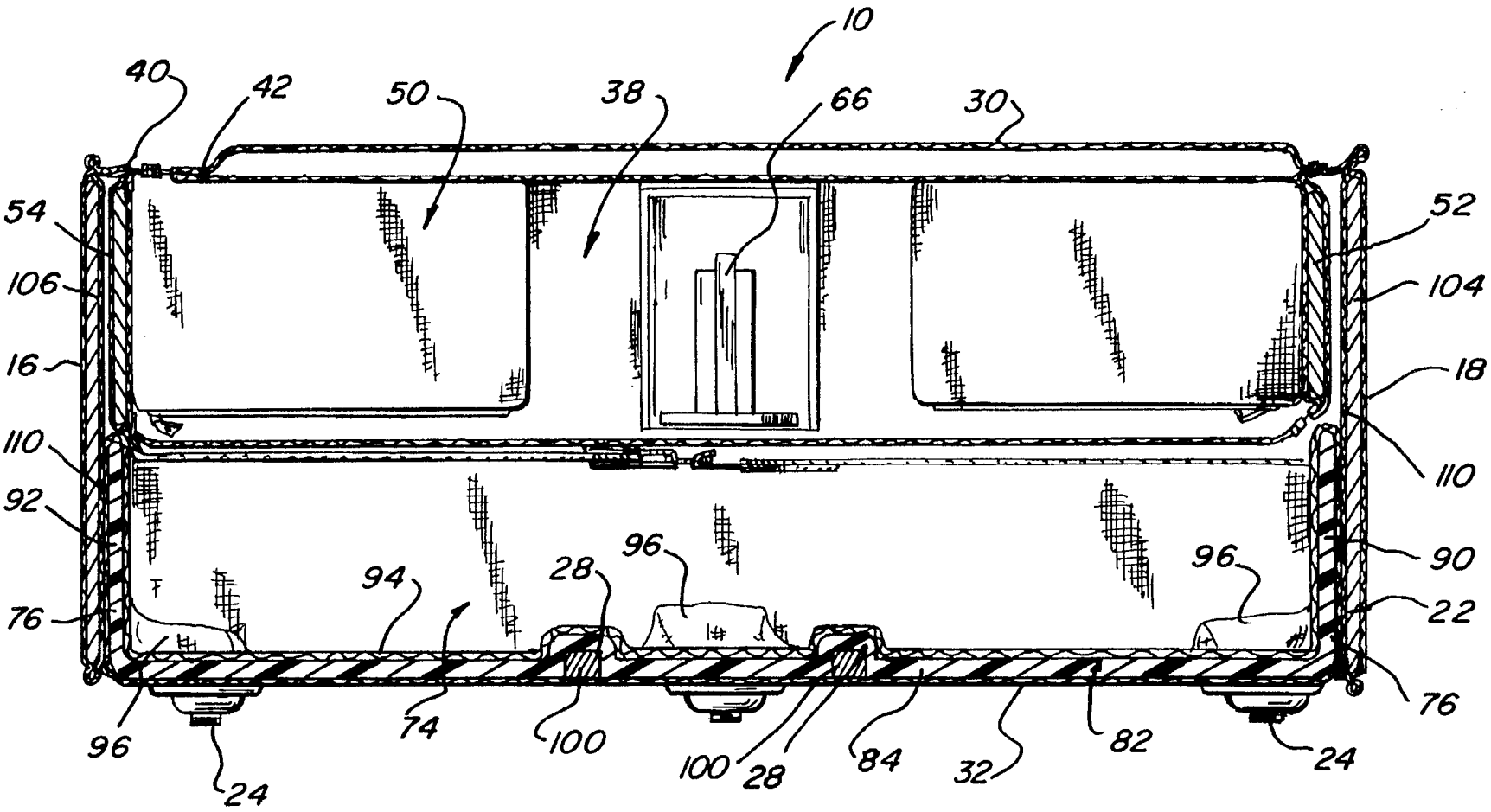
FIG. 8 is a section view taken substantially in the plane of line 8—8 in FIG. 2.

A peripheral interior frame structure generally referenced at 22 in FIGS. 7 and 8 is attached to and located inwardly adjacent of the top panel 12, end panels 16 and 18, and the bottom panel 20. The internal peripheral frame structure 22 provides the shape and weight support capability for the case 10 when it is carried by the carrying handle 14 or the shoulder strap (not shown). The frame structure 22 also allows roller wheels 24 to be attached the case 10 to allow the case to be pulled on the wheels 24. A selectively extendable and retractable maneuvering handle 26 is also attached to the peripheral frame structure 22 so the traveler can maneuver the case 10 on the wheels 24, usually by pulling the case in the direction in which the extended maneuvering handle 26 extends. The maneuvering handle 26 typically extends from and retracts into guide slots 28 (FIG. 8) which extend from approximately the middle of the case between the end panel 16 and 18 and between the frame structure 22 adjacent to the top panel 12 and the bottom panel 20.

Three support skids 29 are attached to the bottom panel 20 at positions opposite the wheels 24. The support skids 29 and the wheels 24 supporting the case 10 when it is set down.

An upper face panel 30 extends across the interior space defined by the rectangular frame structure between upper edges of the top panel 12, the end panels 16 and 18, and the bottom panel 20. Similarly, a bottom face panel 32 (FIGS. 7 and 8) extends parallel to the upper face panel 30 across the bottom of the frame structure between bottom edges of the panels 12, 16, 18 and 20. Various conventional zippered pockets 34 and connection belts 36 may also be optionally be provided in the case 10, for both utilitarian and stylistic purposes.

To provide access to an interior cavity 38 (FIGS. 7 and 8) of the case 10, the upper face panel 30 is divided into a peripheral edge portion 40 and an interior portion 42 which forms an access flap, as shown in FIGS. 1, 2, 3 and 6. Zippers 44 and 46 selectively connect and disconnect the access flap 42 to the peripheral edge portion 40. The access flap 42 continues into the bottom panel 20 at a fold line 48 which extends along the bottom panel 20 between the end panels 16 and 18. Similarly, the zippers 44 and 46 continue into the bottom panel 20 and terminate approximately at the ends of the fold line 48 at positions spaced inwardly from the end panels 16 and 18.

Access to the internal cavity 38 of the case 10 is obtained by unzipping the zippers 44 and 46 and folding the access flap 42 backwards along the fold line 48, as is shown in FIG. 4. Upon folding the access flap 42 back, a packing compartment 50 is revealed. The packing compartment is connected to the access flap 42.

The packing compartment 50 is generally enclosed by two opposing side panels 52 and 54 and an edge panel 56 which is connected to the side panels 52 and 54. The side and edge panels 52 and 54 connect to and extend away from the access flap 42. The side panels 52 and 54 and the edge panels 56 each include within them semi-rigid stiffening material to provide structure, but still allow flexibility for the packing compartment 50. A marginal edge of the flap 42 and the edge panel 56 are connected by the material of the bottom panel 32 adjacent to the fold line 48. A cover panel 58, which is preferably of a mesh-like construction, is attached to the edges of the side panels 52 and 54 and the edge panel 56 by zippers 60 and 62. The cover panel 58 is attached to the access flap 42 along a marginal edge 64 which, when the packing compartment 50 is interfitted into the case 10, is generally adjacent the top panel 12.

Figure 5:
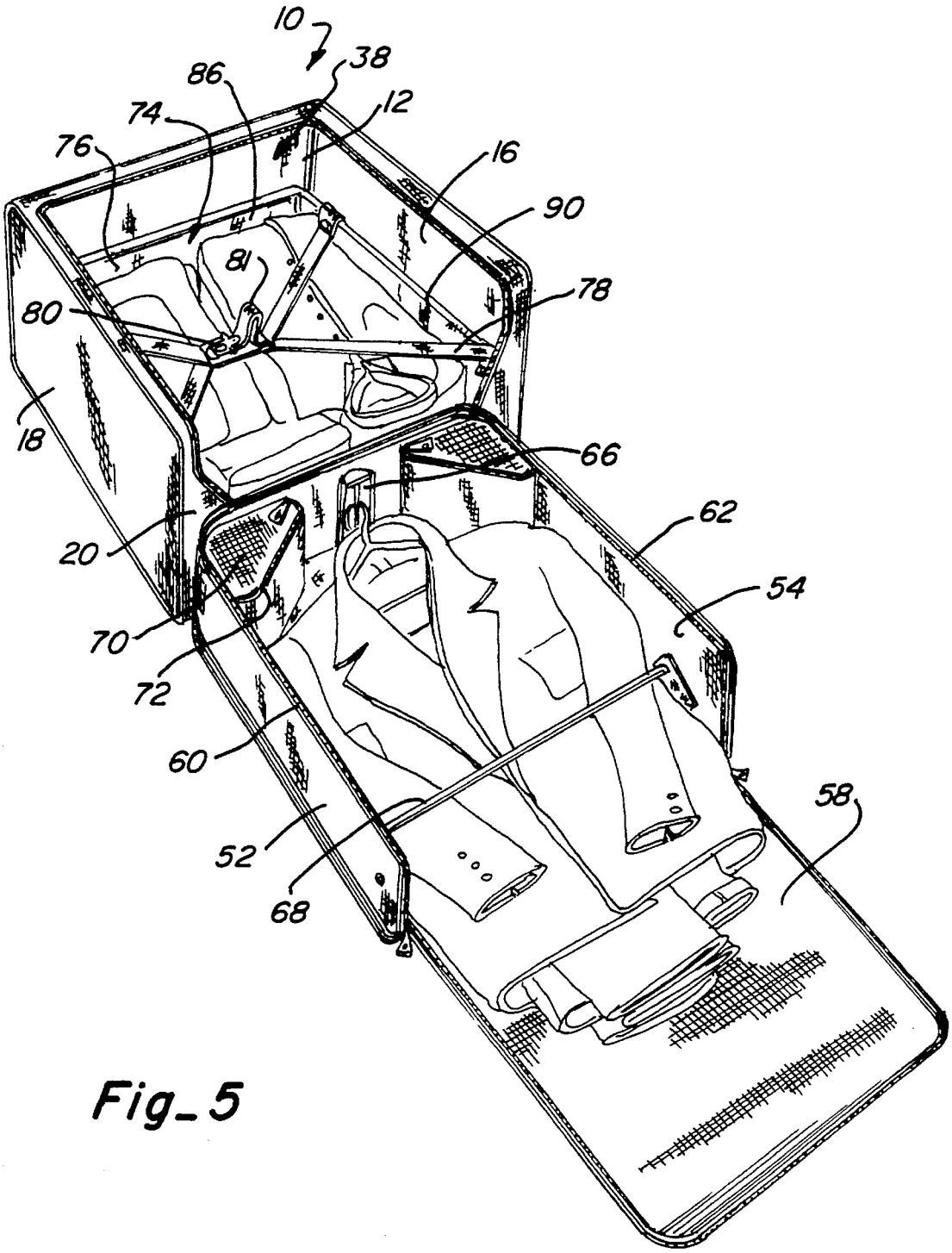
FIG. 5 is a perspective view similar to FIG. 4 illustrating one Of the packing compartments functioning as a garment bag.

By disconnecting the zippers 60 and 62 along the edges of the side panels 52 and 54, and folding the cover panel 58 along the edge 64, and the cover member 58 can be extended flat out beyond the flap 42 in a completely flat manner, as shown in FIG. 5. In this configuration, the packing compartment 50 may function similarly to a conventional garment bag.

A hook connection device 66 is attached to the edge panel 56 by which to support hooks 67 of hangers 69 upon which coats, trousers, dresses and other short or long garments may be supported. Long garments are placed flat along the access flap 42 and the extended cover panel 58. A conventional fold bar 68 is removably connected near the ends of the side panels 52 and 54 above the marginal edge 64 opposite the ends which connect to the edge panel 56. The fold bar 66 is placed on top of the garments which are supported on the access flap 42 and the extended cover panel 58. The lower portions of long garments adjacent the extended cover panel 58 are folded back around the fold bar 68 and over the upper portions of the garments adjacent to the access flap 42. Thereafter, the cover panel 58 is closed on the compartment 50 by closing the zippers 60 and 62 along the side panels 52 and 54 and the edge panel 56.

If the user elects not to use the packing compartment 50 as a garment bag, the packing compartment 50 can be packed in the conventional manner and the cover panel 58 closed to secure the clothing and personal items within the packing compartment. To assist the user in packing small items within the packing compartment 50, corner pockets 70 with zippered access flaps 72 are located in the compartment 50 at the intersection of the side panels 52 and 54 with the edge panel 56. The use of the pockets 70 is conventional in garment bag construction.

A second packing compartment 74 also exists within the interior cavity 38 of the case 10, in addition to the first packing compartment 50, as shown in FIGS. 4, 5, 7 and 8. The second packing compartment 74 is generally enclosed by a rectangularly shaped peripheral structural member 76 which forms a part of the frame structure 22 of the case 10. The rectangular structure 76 is located adjacent to the panels 12, 16, 18 and 20 of the case 10. The depth of the rectangular structure 76 is approximately one-half the depth of the panels 12, 16, 18 and 20 between the upper and lower face panels 30 and 32. Consequently, the second packing compartment 74 preferably occupies approximately half of the volume of the internal cavity 38 while the access panel packing compartment 50 occupies the other half of the internal cavity volume. The sizes of the compartments 50 and 74 need not be equal, but each compartment offers the best utility of each is equal or preferably not less than approximately one third of the volume of the internal cavity 38.

The upper extent of the second packing compartment 74 is generally delineated by packing straps 78. The packing straps 78 are connected in a V-like configuration from opposite sides of the rectangular structure 76. A connector 80 such as a snap connector, belt, or interfitting connector is connected near the point of intersection of the two packing straps on each side of the rectangular structure to connect all four packing straps in a X-like configuration. An adjustment strap 81 may be associated with the connector to pull the packing straps 78 tight. When the connector 80 is connected as shown in FIGS. 4 and 5, the packing straps 78 confine the clothing and personal articles within the second packing compartment 74 to a level which is approximately equal to the upper plane of the rectangular structure 76. The packing straps 78 thus are useful in confining the clothing and personal items into the second packing compartment 74 while also defining the maximum extent into the internal cavity to which the first packing compartment 50 can penetrate into the interior cavity in an interfitting manner.

Of course, when closed by the zippers 60 and 62, the cover panel 58 achieves the function of limiting the amount of clothing and personal care items which can be packed in the first packing compartment 50. By using the packing straps 78 and the cover panel 58 in this manner, the user can accurately gauge the maximum amount of clothing and personal care items which can be inserted into the packing compartments 50 and 74 without overpacking the luggage case to the point where the case contains so much that it will not allow the packing compartment 50 to interfit within the interior cavity 38 and thereby prevent proper use of the case 10.

Details regarding the frame structure 22 which allow the two interfitting packing compartments in a soft-sided luggage case 10 are shown in FIG. 7. A main pan-like structure 82 is formed in a single piece which extends over the bottom face panel 32 and the lower halves of the top panel 12, end panel 16 and 18, and the bottom panel 20. The pan 82 includes a flat bottom portion 84 from which four lip portions 86, 88, 90 and 92 extend upwardly around the periphery of the bottom portion 84. The bottom and lip portions are all integrally connected together to form the pan 82 as a concave structure which opens upwardly toward the portion of the internal cavity 38 occupied by the packing compartment 50 when the case 10 is closed. The lip portions 86, 88, 90 and 92 form the rectangular structure 76 described above.

The bottom portion 84 is located adjacent to the bottom face panel 32, and the top, bottom, and side lip portions 86, 88, 90 and 92 are respectively located interiorly adjacent to the top panel 12, end panels 16 and 18, and bottom panel 20. The bottom lip portion 88 extends upward from the bottom portion 84 to a point which terminates adjacent to the fold line 48. The top lip portion 86 and the side lip portions 90 and 92 terminate at upper edges which are generally adjacent to the plane of the cover panel 58 when the packing compartment 50 is interfitted within the interior cavity 38 and the case 10 is in a closed position. The interior of the pan 82 is covered with flexible fabric material 94. The volume generally enclosed within the pan 82 generally defines the second packing compartment 74, as is shown in FIG. 4.

Outer ends of the packing straps 78 (FIG. 4) are permanently attached near the upper edge of the lip portions 86, 88, 90 and 92 of the pan 82. The straps 78, when joined in the center of the interior cavity 38 by the connector 80, function as packing elements which confine items packed in the second packing compartment 74. The connected straps 78 also contact the cover member 58 to restrain the first packing compartment 50 from moving substantially into the volume of the second packing compartment 74 when the second packing compartment 74 is not fully occupied by items packed therein. In this regard, the connected straps 78 also act as a dividing element for maintaining the separation between the volumes of the packing compartments 50 and 74.

Similarly, wheel assembly cartridges 96 are attached to the pan 82 after the panels 12, 16, 18, 20 and 32 have been placed over the exterior of the pan. The wheel assemblies 96 are conventional items which support the wheels 24 within them. Guide tubes 28 are also formed in the pan 82 for the purpose of receiving rods 100 of the maneuvering handle 26. With the rods 100 fitting within the guide tubes 28, the maneuvering handle 26 can be selectively extended (FIG. 1) or retracted (FIG. 2). The features of the wheel assemblies 96 and the manner in which the maneuvering handle 26 is connected for extension and retraction are conventional and therefore relatively well known.

Also connected near the upper edge of the pan 82 is the carrying handle 14, and connectors (not shown) for attaching a shoulder carrying strap to the case 10, if desired. By connecting the carrying handle and the shoulder carrying strap (if used) to the pan 82 in this manner, sufficient internal structural integrity is achieved to allow the weight within the case to be supported for carrying.

The frame structure 22 also includes semi-rigid or semi-flexible extenders 102, 104 and 106 which respectively overlap the top lip portion 86 and the side lip portions 90 and 92 of the pan 82. The extenders 102, 104 and 106 extend substantially across the full width between the face panels 30 and 32 of the top panel 12 and side panels 16 and 18, respectively, as shown in FIGS. 7 and 8. The extenders 102, 104 and 106 provide structural integrity for the case and complete the outer peripheral frame structure which establishes the basic the drum construction of the case 10. A reinforcement piece 108 is connected to the upper edge of the extender 102 and extends generally along the peripheral edge portion 40 of the upper face panel 30. The edge panel 56 of the packing compartment 50 extends from the upper end of the bottom lip portion 92 of the pan 82 and is connected at the fold line 48 by the flexible fabric of the bottom panel 20. Fabric material 110 covers the extenders 102, 104 and 106 and the reinforcement 108 facing into the interior cavity 38 of the case.

The extenders 102, 104 and 106 provide the interior structural reinforcement for the peripheral edge portion 40 of the upper face panel 30, thereby allowing the packing compartment 50 to interfit within the interior cavity 38. Because the extenders 102, 104 and 106 have some flexibility, the packing compartment 50 is more easily interfit with the side edges 52 and 54 overlapped with and adjacent to the extenders 104 and 106, if the extenders 104 and 106 are generally held in an advantageous position to allow the zippers 60 and 62 to connect the packing compartment 50 interiorly within the case 10.

Triangular portions 112 of the bottom panel 12 extend inwardly from the side panels 16 and 18 to the fold line 48. The zippers 60 and 62 follow the edge of these triangular portions 112. The triangular portions 112 prevent the extenders 104 and 106 along the side panels 16 and 18 from bending outwardly at least in the area of the bottom panel 20. To a certain extent, the triangular panels also prevent the extenders 104 and 106 from deflecting inwardly, although the inward deflection does not create as difficult of a closure situation for the zippers 60 and 62, since the interfitting insertion of the packing compartment 50 into the cavity will force the extenders outward. By preventing the outward deflection, the zippers 60 and 62 may easily be started and moved from the fold line toward the top panel 12. The triangular portions 112 do not inhibit the closure of the packing compartment 50 into the internal cavity 38 because the rounded corners where the side and end panels 52, 54 and 56 is sufficiently rounded to clear the triangular portions.

Once the zippers 60 and 62 move from the bottom panel 20 onto the lower edge of the upper face panel 30, it is generally easy to continue closing the zippers, particularly with the straps 78 supporting the packing compartment 50. The reinforcement 108 presents structural support for the peripheral edge portion 40 and holds it generally in position to allow the zippers to continue to close along the upper margin of the upper face panel 30.

Most of the construction techniques for joining separate panels and components of the soft-sided case together are conventional, and need not be described in detail beyond that presented above.

Many significant advantages and improvements occur as a result of the present invention. By arranging the case 10 as described above, the advantages of having two equally and independently accessible packing compartments 50 and 74 are available. Each packing compartment can be packed independently of and without access to or through the other packing compartment. The sizes of the packing compartments are relatively well defined by the position of the packing strap 78 and the cover panel 58, thereby alerting the user of the difficult or impossible situation of overpacking the case 10. The case 10 can be packed and unpacked with the convenience similar to that obtained with conventional hard-sided, hinged, concave shell suitcases, due to the interfitting and folding relationship of the packing compartment 50 relative to the internal cavity 38. The conveniences and desirability of the styling and utilitarian aspects of a soft-sided case are preserved, and no hardware or other types of connection devices beyond those typical for a soft-sided case are employed to obtain this functionality. The packing compartment which folds out of the case may be advantageously arranged to function similar to the packing capability provided by a garment case.

A presently preferred embodiment of the invention and its many improvements and features have been described with a degree of particularity. This description is of the preferred example for implementing the invention. The scope of the invention should not necessarily be limited to this description. The scope of the present invention is defined by the following claims.

The invention claimed is:

1. In an operable and closeable soft-sided luggage case of the suitcase type having a peripheral frame structure defining opposing top and bottom panels, opposing end panels and opposing face panels arranged in a substantially rectangular configuration, said panels surrounding an internal cavity, and one of a carrying handle or a carrying strap connected to the frame structure for carrying the case; an improvement comprising:

a first packing compartment connected to a flap on one face panel and extending into the interior cavity and consuming a portion of the interior cavity when the case is closed, the remaining portion of the interior cavity forming a second packing compartment; and a zipper extending along edges of the flap and along edges of the one face panel of which the flap is a part by which to open and close the case; and wherein:

the first packing compartment includes a cover member which is selectively closeable for separating the first and second packing compartments when the case is closed and which is selectively openable for allowing access to the first packing compartment when the case is opened with the first packing compartment moved out of the internal cavity of the case;

the first packing compartment includes side panels connected to the flap; and the first packing compartment interfits within the end panels when the case is closed so that the end panels are adjacent to and overlap the side panels of the first packing compartment.

2. An improved luggage case as defined in claim 1 wherein:

the one face panel and the first packing compartment fold back and away from the interior cavity when the zipper is opened; and the first and second packing compartments being equally accessible and available for packing when the first packing compartment is folded back and away from the interior cavity.

3. An improved luggage case as defined in claim 1 wherein:

the flap is pivotably connected to a panel along a fold line;

the flap and the first packing compartment fold back and away from the interior cavity; and the first and second packing compartments are equally accessible for packing when the flap is folded back and away from the interior cavity.

4. An improved luggage case as defined in claim 3 wherein:

the space in the one face panel occupied by the flap when the flap is closed allows access to the second packing compartment when the flap and the first packing compartment are folded back and away from the interior cavity.

5. An improved luggage case as defined in claim 3 wherein:

the fold line is located on the bottom panel and extends generally between the end panels.

6. An improved luggage case as defined in claim 1 wherein:

the first packing compartment forms a garment bag and includes a hook connection device for connecting to hangers which hold garments.

7. An improved luggage case as defined in claim 6 wherein:

the cover member folds outward when opened to extend away from the flap and allow long garments on hangers to rest on the flap and the extended cover member and to fold back into the first packing compartment when the cover member is closed.

8. An improved luggage case as defined in claim 7 wherein:

the first packing compartment further includes a fold bar extending between the side panels.

9. An improved luggage case as defined in claim 7 wherein:

the first packing compartment further includes at least one corner pocket positioned between a side panel and the hook connection device.

10. An improved luggage case as defined in claim 1 wherein:

the second packing compartment includes a packing element extending within the interior cavity to confine items packed within the second packing compartment.

11. An improved luggage case as defined in claim 10 wherein:

the packing element contacts the cover member when the case is closed to inhibit the first packing compartment from consuming the portion of the interior cavity forming the second packing compartment.

12. An improved luggage case as defined in claim 1 wherein:

the second packing compartment includes a dividing element which is selectively extendable within the interior cavity to contact the cover member when the case is closed to inhibit the first packing compartment from consuming the portion of the interior cavity forming the second packing compartment.

13. An improved luggage case as defined in claim 1 wherein:

the case includes wheels for rolling the case and a maneuvering handle by which to maneuver the case on the wheels, and the wheels and the maneuvering handle are connected to the peripheral frame structure.

14. In an openable and closeable soft-sided luggage case of the suitcase type having a peripheral frame structure defining opposing top and bottom panels, opposing end panels and opposing face panels arranged in a substantially rectangular configuration, said panels surrounding an internal cavity, and one of a carrying handle or a carrying strap connected to the frame structure for carrying the case; an improvement comprising:

a first packing compartment connected to a flap on one face panel and extending into the interior cavity and consuming a portion of the interior cavity when the case is closed, the remaining portion of the interior cavity forming a second packing compartment;

the first packing compartment includes a cover member which is selectively closeable for separating the first and second packing compartments when the case is closed and which is selectively openable for allowing access to the first packing compartment when the case is opened with the first packing compartment moved out of the internal cavity of the case;

the first packing compartment includes side panels connected to the flap;

the first packing compartment interfits within the end panels when the case is closed so that the end panels are adjacent to and overlap the side panels of the first packing compartment; and wherein:

the side panels of the first packing compartment and the end panels of the case include stiffeners which extend the side panels and end panels to facilitate the adjacent and overlapping relationship of the side panels and the end panels upon the interfitting closure of the first packing compartment in the interior cavity of the case.

15. An improved luggage case as defined in claim 14 wherein the structure of the case includes a pan-like member which includes a bottom portion extending along the other one one of the face panels and lip portions extending adjacent to the top, bottom and end panels, and wherein:

the stiffeners in the side panels contact the lip portions adjacent to the end panels.

16. An improved luggage case as defined in claim 15 wherein:

the second packing compartment is generally defined by the bottom and lip portions of the pan-like member.

17. An improved luggage case as defined in claim 16 wherein:

a packing element extends within the interior cavity from the lip portions of the pan-like member to assist in confining items packed within the second packing compartment.

18. An improved luggage case as defined in claim 17 wherein:

the packing element comprises straps; and the straps extend from locations on the lip portions opposite the bottom portion of the pan-like member.

19. An improved luggage case as defined in claim 15 wherein the case includes wheels for rolling the case and a maneuvering handle by which to maneuver the case on the wheels, and the wheels and the maneuvering handle are connected to the pan-like member.

20. An improved luggage case as defined in claim 14 wherein:

the one face panel and the first packing compartment fold back and away from the interior cavity when the zipper is opened; and the first and second packing compartments being equally accessible and available for packing when the first packing compartment is folded back and away from the interior cavity.

21. An improved luggage case as defined in claim 14 wherein:

the first packing compartment forms a garment bag and includes a hook connection device for connecting to hangers which hold garments.

22. An improved luggage case as defined in claim 21 wherein:

the cover member folds outward when opened to extend away from the flap and allow long garments on hangers to rest on the flap and the extended cover member and fold back into the first packing compartment when the cover member is closed.

23. An improved luggage case as defined in claim 22 wherein:

the first packing compartment further includes a fold bar extending between the side panels.

24. An improved luggage case as defined in claim 22 wherein:

the first packing compartment further includes at least one corner pocket positioned between a side panel and the hook connection device.

25. An improved luggage case as defined in claim 14 wherein:

the second packing compartment includes a packing element extending within the interior cavity to confine items packed within the second packing compartment.

26. An improved luggage case as defined in claim 25 wherein:

the packing element contacts the cover member when the case is closed to inhibit the first packing compartment from consuming the portion of the interior cavity forming the second packing compartment.

27. An improved luggage case as defined in claim 14 wherein:

the second packing compartment includes a dividing element which is selectively extendable within the interior cavity to contact the cover member when the case is closed to inhibit the first packing compartment from consuming the portion of the interior cavity forming the second packing compartment.

28. An improved luggage case as defined in claim 14 wherein:

the case includes wheels for rolling the case and a maneuvering handle by which to maneuver the case on the wheels, and the wheels and the maneuvering handle are connected to the peripheral frame structure.

29. A soft-sided luggage case comprising:

a substantially rectangular outer peripheral frame structure;

flexible material attached to the outer peripheral frame structure to define opposing top and bottom panels, opposing end panels and a bottom face panel, said panels defining a substantially rectangular internal cavity which is open opposite the bottom face panel;

a substantially rectangular first interior frame structure;

flexible material attached to the first interior frame structure to define opposing side panels, opposing edge panels and a top face panel, said panels defining a substantially rectangular first packing compartment adapted to receive clothing and personal items;

a flexible cover;

means for selectively attaching the flexible cover to the opposing side and edge panels of the first packing compartment to selectively open and close the first packing compartment;

a substantially rectangular second interior frame structure fixed to the outer peripheral frame structure and defining a second packing compartment within the internal cavity adapted to receive clothing and personal items;

a first edge panel of the first packing compartment pivotably connected to the bottom panel to allow the first packing compartment to selectively pivot into and out of the internal cavity so that the top face panel is opposite the bottom face panel when the first packing compartment is within the internal cavity, said first and second packing compartments being adapted to receive clothing and personal items substantially only when the first packing compartment is pivoted out of the internal cavity; and a zipper extending along a periphery of the top face panel of the first packing compartment, said zipper operable to secure the first packing compartment to the flexible material attached to the outer peripheral frame structure when the first packing compartment is pivoted within the internal cavity to maintain the first packing compartment in a closed position within the internal cavity.

30. A soft-sided luggage case as defined in claim 29 wherein:

the clothing and personal items in the second packing compartment are confined within the second packing compartment by contact with the flexible cover when the first packing compartment is pivoted into the internal cavity.

31. A soft-sided luggage case as defined in claim 30, further comprising:

straps attached to the second interior frame structure and adapted to extend across the second packing compartment to assist in confining the clothing and personal items within the second packing compartment.

32. A soft-sided luggage case as defined in claim 31 wherein:

the first packing compartment contacts the straps extending across the second packing compartment to limit the pivotable movement of the first packing compartment within the internal cavity and inhibit the first packing compartment from extending into the second packing compartment.

33. A soft-sided luggage case as defined in claim 29 wherein:

the first edge panel includes a central portion and opposing end portions adjacent the central portion;

the central portion of the first edge panel is pivotably connected to the bottom panel; and the zipper extends along the opposing end portions of the first edge panel in addition to the periphery of the top face panel to secure the end portions of the first edge panel to the bottom panel when the first packing compartment is pivoted within the internal cavity.

34. A soft-sided luggage case as defined in claim 29 wherein:

the first packing compartment contacts the second interior frame structure when the first packing compartment is pivoted within the internal cavity, said contact limiting the pivotable movement of the first packing compartment within the internal cavity to inhibit the first packing compartment from extending into the second packing compartment.

35. A soft-sided luggage case as defined in claim 29 wherein:

the first packing compartment may be pivoted out of the internal cavity to an open position when the zipper is opened; and the first and second packing compartments are equally accessible for packing when the first packing compartment is pivoted to the open position and the flexible cover on the first packing compartment is opened.

36. A soft-sided luggage case as defined in claim 35 wherein:

the first and second packing compartments each consume at least one third of the volume of the internal cavity.

37. An improved luggage case as defined in claim 36 wherein:

the first and second packing compartments are substantially comparable in size.

38. A soft-sided luggage case as defined in claim 29 wherein:

the means for selectively opening and closing the first packing compartment comprises a second zipper extending along a peripheral edge of the flexible cover and the opposing side and edge panels.

39. A soft-sided luggage case as defined in claim 38 wherein:

the flexible cover and a second edge panel opposite the first edge panel comprise a single piece of flexible material foldably connected to an edge of the top face panel; and the second zipper connects opposite ends of the second edge panel to the opposing side panels and connects the peripheral edge of the flexible cover to the opposing side panels and the first edge panel.

40. A soft-sided luggage case as defined in claim 39 wherein:

the first packing compartment provides garment bag packing capability and includes a hook connection device for connecting to hangers which hold garments.

41. A soft-sided luggage case as defined in claim 40 wherein:

the hook connection device is located adjacent to the first edge panel;

the flexible cover and the second edge panel fold outward to extend away from the top face panel to allow long garments on hangers to rest on the top face panel, the second edge panel and the extended flexible cover and to fold back into the first packing compartment when the second edge panel and the flexible cover are closed.

42. A soft-sided luggage case as defined in claim 41 wherein:

the first packing compartment further includes a fold bar extending between the opposing side panels.

43. A soft-sided luggage case as defined in claim 41 wherein:

the first packing compartment further includes at least one corner pocket positioned between a side panel and the first edge panel adjacent to the hook connection device.

44. A soft-sided luggage case as defined in claim 29 wherein:

the first packing compartment forms a garment bag and includes a hook connection device for connecting to hangers which hold garments.

45. A soft-sided luggage case as defined in claim 29 wherein the case includes wheels for rolling the case and a maneuvering handle by which to maneuver the case on the wheels, and the wheels and the maneuvering handle are connected to the second interior frame structure.

* * * * *